United States Patent [19]

Hasegawa et al.

[11] Patent Number: 4,804,041

[45] Date of Patent: Feb. 14, 1989

[54] HEAT-EXCHANGER OF PLATE FIN TYPE

[75] Inventors: Kaoru Hasegawa, Utsunomiya; Shozo Uto; Suzushi Hashimoto, both of Oyama, all of Japan

[73] Assignee: Showa Aluminum Corporation, Osaka, Japan

[21] Appl. No.: 862,721

[22] Filed: May 13, 1986

[30] Foreign Application Priority Data

May 15, 1985 [JP] Japan ..... 60-104768

[51] Int. Cl.[4] ..... F28F 3/00

[52] U.S. Cl. ..... 165/166; 165/916

[58] Field of Search ..... 165/166, 152, 153, 916

[56] References Cited

U.S. PATENT DOCUMENTS

| | | | |
|---|---|---|---|
| 1,899,080 | 2/1933 | Dalgliesh | 165/153 |
| 2,752,128 | 6/1956 | Dedo | 165/174 |
| 3,613,782 | 10/1971 | Mason et al. | 165/166 |
| 3,635,283 | 1/1972 | Satchwell | 165/152 X |
| 4,434,845 | 3/1984 | Steeb | 165/153 |

FOREIGN PATENT DOCUMENTS

| | | | |
|---|---|---|---|
| 79663 | 7/1919 | Austria | 165/152 |
| 55-64687 | 5/1980 | Japan . | |
| 490556 | 8/1938 | United Kingdom | 165/152 |

*Primary Examiner*—Ira S. Lazarus
*Assistant Examiner*—Richard R. Cole
*Attorney, Agent, or Firm*—Armstrong, Nikaido Marmelstein & Kubovcik

[57] ABSTRACT

A plate fin heat exchanger having a first flow channel and a second flow channel which are formed by at least three flat plates arranged in parallel with one another at a predetermined spacing and opposed side walls provided between the adjacent flat plates. A platelike wall interconnecting the side walls is provided within at least one of the first and second flow channels and has a multiplicity of projections arched when seen from one side and formed by cutting the interconnecting wall and being projected upward and downward. Each of the arched projections is opposed to a fluid passage.

1 Claim, 3 Drawing Sheets

HEAT-EXCHANGER OF PLATE FIN TYPE

BACKGROUND OF THE INVENTION

The present invention relates to heat-exchangers of the plate fin type, for example, for use in oil coolers and the like.

The term "aluminum" as herein used includes aluminum and aluminum alloys.

Conventional oil coolers made, for example, of aluminum have first flow channels for passing an oil therethrough and second flow channels for passing air therethrough in a direction intersecting the first channels at right angles therewith, the first and second channels being arranged alternately one above the other as separated by a flat plate. Each of these flow channels is formed by a pair of flat plates disposed in parallel with each other at a specified spacing, spacer bars provided between the flat plates and serving as opposite side walls, and corrugated fins arranged between the spacer bars. The spacer bars and the corrugated fins are joined together, for example, by vacuum brazing, as held between the flat plates each comprising an aluminum brazing sheet. However, the conventional oil cooler is composed of a large number of parts, therefore requires much time for setting the parts, is not easily settable automatically, is inefficient to fabricate and is heavy.

The conventional oil cooler has fins such as multientry fins (offset fins) within the oil passing first flow channels. The conventional fins, which have projections at a small spacing, afford a relatively large amount of heat exchange to achieve a high efficiency, whereas they result in a very great pressure loss, consequently requiring an increased pump output pressure to maintain the desired oil pressure and entailing a corresponding increase in equipment cost as well as in power cost. The pressure loss may be diminished by increasing the spacing between the fin projections, but a reduced heat exchange efficiency will then result.

SUMMARY OF THE INVENTION

The main object of the present invention is to provide a heat exchanger of the plate fin type which is free of the foregoing problems.

The present invention provides a heat exchanger of the plate fin type having a first flow channel and a second flow channel which are formed by at least three flat plates arranged in parallel at specified spacings and opposite side walls provided between the adjacent flat plates. The exchanger is characterized in that a platelike connecting wall interconnecting the side walls is provided within at least one of the first and second flow channels and has a multiplicity of projections arched when seen from one side and formed by cutting and being projected upward and downward, each of the arched projections being opposed to a fluid passage.

The plate fin heat exchanger of the present invention is composed of a decreased number of parts which are readily settable automatically within a greatly shortened period of time. The heat exchanger can therefore be manufactured with an increased efficiency.

The present heat exchanger permits oil or like fluid to pass therethrough as disturbed fully and very effectively while allowing the fluid to smoothly flow therethrough with a greatly reduced pressure loss to achieve an increased amount of heat exchange for efficient heat exchange without necessitating a higher pump output pressure. Accordingly the heat exchanger is low in equipment cost and power cost and is economical, while the device can be fabricated with a reduced amount of material, which renders the device lightweight and less costly.

The present invention will be described below in greater detail with reference to the accompanying drawings.

DESCRIPTION OF THE PREFERRED EMBODIMENTS

Figure 1:
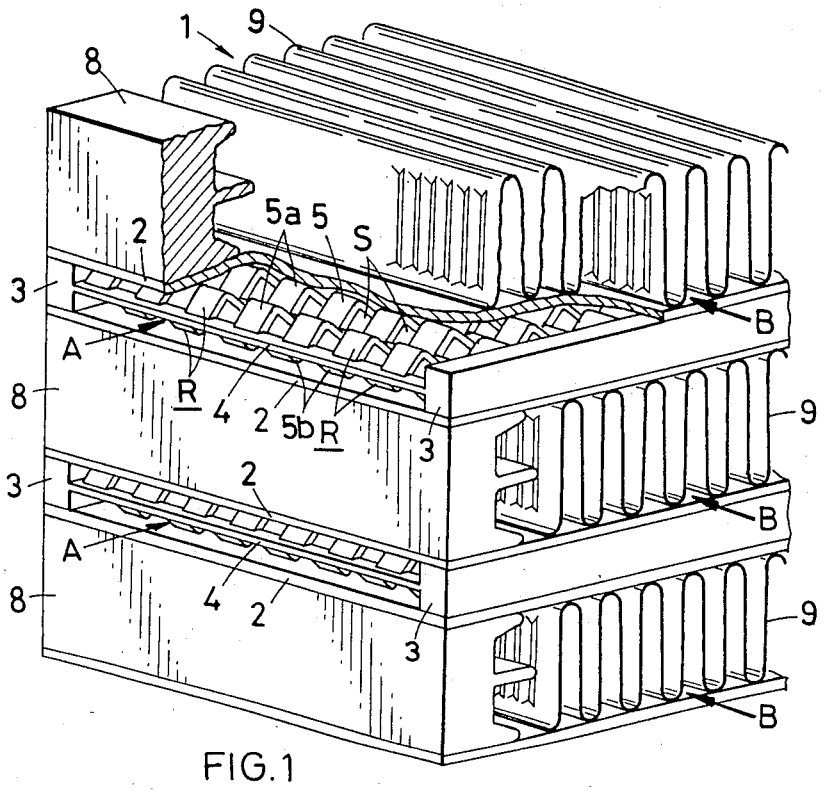
FIG. 1 is a fragmentary perspective view partly broken away and showing a heat exchanger embodying the present invention.
Figure 2:
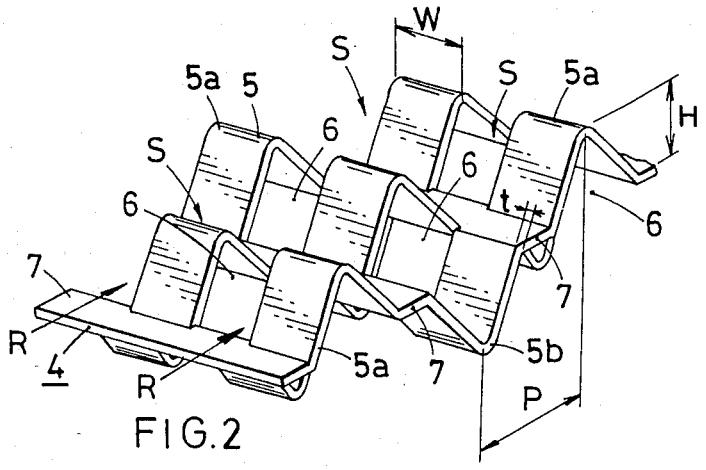
FIG. 2 is an enlarged fragmentary perspective view showing a fin portion of the heat exchanger of FIG. 1.
Figure 3:
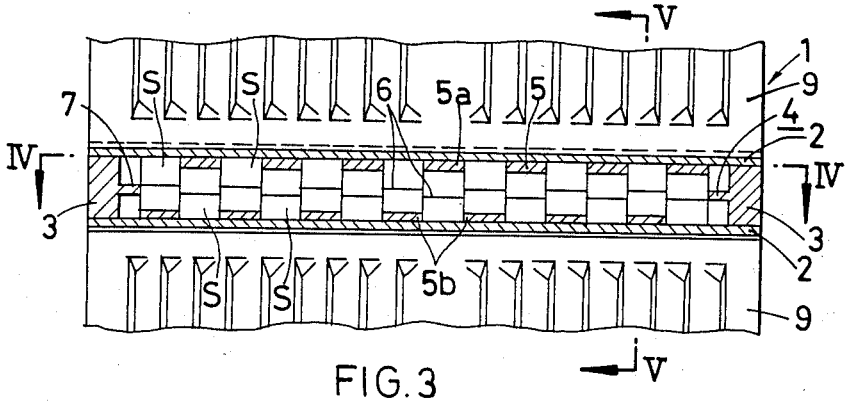
FIG. 3 is an enlarged fragmentary view in vertical section of the heat exchanger.
Figure 4:
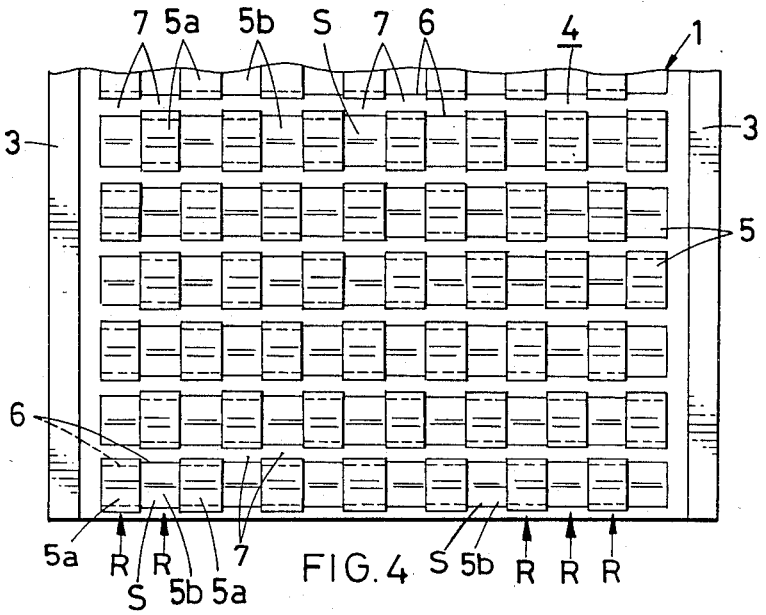
FIG. 4 is an enlarged view in section taken along the line IV—IV in FIG. 3.
Figure 5:
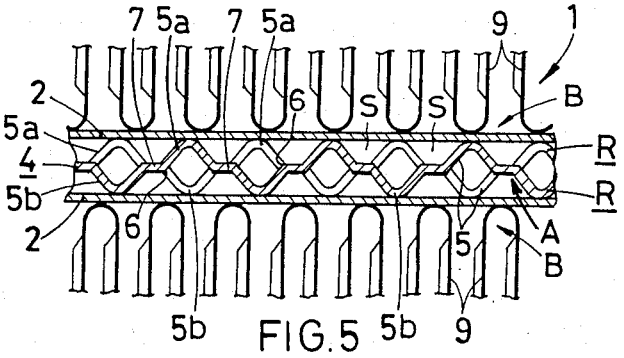
FIG. 5 is an enlarged view in section taken along the line V—V in FIG. 3.

The terms "front," "rear," "right," "left," "upward" and "downward" as herein used are based on FIG. 3; "front" refers to the front side of the plane of FIG. 3, "rear" to the rear side of the same, "right" to the right side of FIG. 3, "left" to the left side of the same, "upward" to the upper side of the same, and "downward" to the lower side of the same.

With reference to FIGS. 1 to 5, a plate fin heat exchanger 1 of the present invention is used, for example, as an oil cooler and has first flow channels A and second flow channels B arranged alternately one above another and separated by flat plates 2 each comprising an aluminum brazing sheet. An oil is passed through the first flow channels A, while air is passed through the second flow channels B. The channels A and B are so arranged that the fluids are passed in directions intersecting each other at right angles.

Each first flow channel A is formed by two adjacent flat plates 2 positioned one above the other and opposed right and left side walls 3 provided between the plates 2. The side walls 3 and a platelike connecting wall 4 interconnecting these walls are integrally made of an aluminum extruded material. The connecting wall 4 has a multiplicity of arched projections 5 having an upwardly projecting and approximately inverted V-shaped section and a multiplicity of like projections 5 having a downwardly projecting and approximately V-shaped section. The wall 4 has a fluid passage 6 opposed to each arched projection 5.

On the other hand, each second flow channel B is formed by two adjacent flat plates 2 positioned one above the other and opposed front and rear side walls 8 provided between these plates 2 and made of extruded aluminum material. Provided between the opposed front and rear walls 8 is a louvered corrugated fin 9 having ridges and furrows in parallel with these walls 8.

While the arched projections 5 of the interconnecting wall 4 within the first flow channel A may be in a desired arrangement, the connecting wall 4 of the present embodiment has a plurality of rows R of such projections, each row R including a multiplicity of upwardly and downwardly projecting arched projections 5 arranged in the front-to-rear direction.

Each of the arched projetions 5 has a wall thickness t of 0.5 to 1.5 mm, a width W of t to 10 t and a height H of 2 to 10 mm. The projections 5 in each row R are arranged at a pitch P of 3 to 30 mm.

When the wall thickness t of the arched projection 5 is less than 0.5 mm, the projection, which is excessively thin, is likely to break while it is being so shaped, whereas if it is more than 1.5 mm, the projection 5 is too thick and difficult to shape, necessitating an increased amount of aluminum material to result in an increased cost. When the width W of the arched projection 5 is as small as less than t (equal to the wall thickness), a lower heat exchange efficiency will result, whereas if it is in excess of 10 t (10 times the wall thickness), the excessively wide projections result in a greater pressure loss. When less than 2 mm in height H, the projections 5 result in an impaired heat exchange efficiency and provide narrow fluid passages to impede smooth flow of the fluid. Heights H exceeding 10 mm are not desirable since the strength against pressure will then decrease. If the pitch P of the projections 5 is as small as less than 3 mm, an increased pressure loss will then result, while the projections 5 will not be shaped satisfactorily. When the pitch P is in excess of 30 mm, reduced strength against pressure and impaired heat exchange efficiency will result, hence objectionable.

In each projection row R of the connecting wall 4, there remains a horizontal portion 7 between each upwardly projecting arched projection 5*a* and the downwardly projecting arched projection 5*b* immediately adjacent thereto. The oil through the first flow channel A flows in the direction of the rows R, and the walls of the arched projections 5*a* and 5*b* are opposed to the flow of the oil.

The upward projections 5*a*, as well as the downward projections 5*b*, of the rows R immediately adjacent to each other transversely of the rows are in a staggered arrangement, and each upward projection 5*a* is immediately adjacent to the downward projection 5*b* in the transverse direction.

While the projection rows R adjacent to each other have no spacing therebetween as illustrated, a horizontal portion extending in the front-to-rear direction may be left between the rows R to thereby space the rows R apart by a distance of up to 10t. If the distance or spacing exceeds 10t, the fluid will flow readily to result in a greatly impaired heat exchange efficiency, hence undesirable.

In section, the arched projection 5 may be in the shape of ⌐, ⌣, ⌒ or ⌣. The fluid passage 6 opposed to each arched projection 5 communicates with an opening at each side of the projection 5, permitting the oil to readily flow into the passage 6.

The opposed side walls 3 and the platelike wall 4 interconnecting these walls 3 are made integrally of an extruded aluminum material. The multiplicity of upward and downward arched projections 5*a*, 5*b* are shaped in the connecting wall 4 by a press or forming rolls while forming the fluid passages 6 identical in number to the number of projections, with horizontal portions 7 of specified width left between the projections 5*a* and 5*b*. Since the multiplicity of projections 5*a*, 5*b* are formed by cutting and raising the planar connecting wall 4, the flow channel can be formed with use of a reduced amount of material, consequently rendering the heat exchanger 1 lightweight.

The heat exchanger 1 can be fabricated by arranging in superposed layers flat plates 2 each in the form of an aluminum brazing sheet, pairs of opposed side walls 3 each having the connecting wall 4 formed with arched projections 5, and pairs of front and rear walls 8 each having the louvered corrugated fin 9, and joining the components together, for example, by vacuum brazing.

At least three flat plates 2 are used. Accordingly, the smallest heat exchanger 1 theoretically has one first flow channel A and one second flow channel B. For actual use as an oil cooler for example, the heat exchanger 1, if small, has 3 to 20 first flow channels A and 3 to 20 second flow channels B. When of an intermediate size, the heat exchanger is 21 to 50 in the number of channels A as well as of channels B. The number is 51 to 100 for heat exchangers of large size. Since the flow channels A and B are arranged alternately, the two types of channels are equal in number, or one is larger than the other in number by only one. Such numbers of channels A and B are mentioned only as examples; the number of channels A, as well as of channels B, is determined according to the size and efficiency of the contemplated heat exchanger 1. When required, instead of arranging the flow channels A and B alternately, a plurality of channels of one type are arranged as superposed for each of channels of the other type.

When a brazing sheet is used as the flat plate 2, the top ends of the arched projections 5 of the connecting wall 4 are usually joined to the flat plate 2 by the brazing material layer, but the projection top ends may be held out of contact with the flat plate 2. The heat exchanger can be fabricated alternatively by using aluminum plates as the flat plates 2 in place of aluminum brazing sheets, applying with a brush a brazing material to the upper and lower surfaces of the opposed side walls 3 and of front and rear walls 8, and joining the parts together with the layer of brazing material.

With the heat exchanger 1 described above, the opposite ends of the oil passing first flow channels A are made to communicate with an unillustrated header tank, and oil is passed through the channels A by a pump having a predetermined output pressure. On the other hand, the air passing second flow channels B are left open at their opposite ends, and air is passed through the channels B forcedly by a fan or spontaneously owing to the travel of the vehicle or the like in which the exchanger is installed.

When flowing through each first flow channel A, the oil strikes against the front surfaces of the multiplicity of arched projections 5*a*, 5*b* formed on the connecting wall 4 and having a V-shaped or inverted V-shaped section and further flows around the opposite sides of the projections 5*a*, 5*b* into the fluid passages 6 from above downward or from below upward in the form of turbulent streams. According to the present embodiment, the horizontal portion 7 of specified width is provided between each two adjacent projections 5*a*, 5*b* in each row R, the upward projections 5*a* and the downward projections 5*b* of the rows R immediately adjacent to each other transversely of the rows are in a staggered arrangement, each upward projection 5*a* is adjacent to two downward projections 5*b* at its right and left sides, each downward projections 5*b* is adjacent to two upward projections 5*a* at its right and left sides, and each of the projections 5*a*, 5*b* has at each side thereof a wide space S corresponding to one projection 5 and front and rear two horizontal portions 7. This arrangement permits the oil to flow around the opposite sides of each projection 5 very smoothly without resulting in pressure loss. In each space S which is surrounded at its four sides by upward projections 5*a* or downward projections 5*b*, the oil flowing around the front and right and left side projections 5 can be fully agitated. The oil then strikes against the upward projection 5*a* and flows around the opposite sides thereof into opposite spaces S and then into the fluid passage 6 in downward streams. Alternatively, the oil strikes against the downward projection 5*b* and flows around the opposite sides thereof into the fluid passage 6 in upward streams. Consequently, the oil flows through the first flow channel A while being disturbed and fully agitated to achieve a remarkably improved heat exchange efficiency.

When actually used as an oil cooler, the heat exchanger 1 of the above embodiment was equivalent to or up to 7% higher than conventional oil coolers in heat release efficiency (heat exchange efficiency) and was 10 to 30% smaller in pressure loss. Accordingly, the heat exchanger is usable with a pump of lower output pressure and assures savings in equipment cost and power cost.

Figure 6:
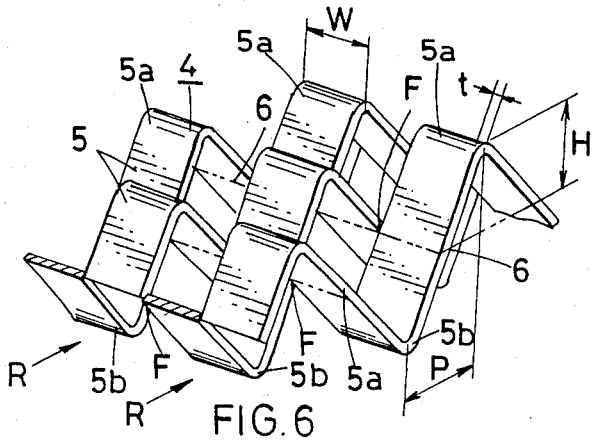
FIG. 6 is an enlarged perspective view showing a fin portion of another embodiment of the invention.
Figure 7:
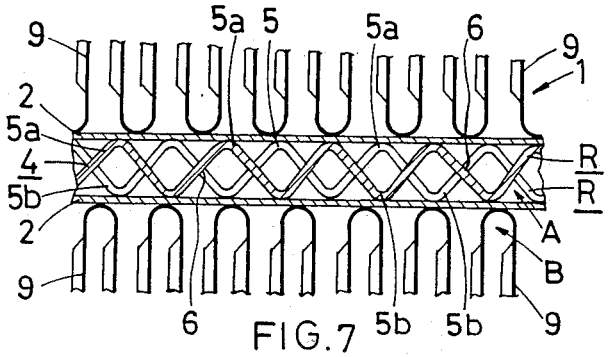
FIG. 7 is an enlarged fragmentary view in vertical section corresponding to FIG. 5 and showing the second embodiment.

FIGS. 6 and 7 show another embodiment of the invention, which differs from the foregoing embodiment in that there is no horizontal portion between the adjacent arched projections 5*a*, 5*b* in each projection row R. In this case, the arched projections 5*a*, 5*b* of the rows R adjacent to each other transversely of the rows are firmly joined together at intersections F each in the form of a cross when seen from one side as shown in FIG. 7.

Since the second embodiment is the same as the first with the exception of the above feature, like parts are designated by like reference numerals throughout the drawings.

The heat exhanger 1 described above is useful as an oil cooler, for example, for cooling engine oil, for cooling industrial machines and for cooling the oil of various hydraulic systems.

Although the lengthwise direction of the arched projections 5*a*, 5*b* in each row R matches the direction of flow of oil in the case of the illustrated heat exchanger 1, these projections 5*a*, 5*b* may be arranged as inclined by a required angle with respect to the direction of the oil flow insofar as the oil can be disturbed and agitated effectively as described above.

With the heat exchanger 1 described above, the first flow channel A only is composed of two flat plates 2 positioned one above the other and opposed side walls 3 provided between the plates 2 and having a connecting wall 4 formed with a multiplicity of arched projections 5*a*, 5*b* and fluid passages 6, whereas the second flow channel B also may have the same construction as the channel A when so required.

Although the first and second flow channels A, B of the illustrated heat exchanger 1 are arranged in directions intersecting each other at right angles, the two types of channels A, B may be arranged in parallel. In this case, two fluids are passed through the channels A, B cocurrently or in opposite directions.

Although the illustrated heat exchanger 1 is useful as an oil cooler of the horizontal type with the first flow channels A in a horizontal position, the heat exchanger 1 may alternatively be used as an oil cooler of the vertical type with the first flow channels A positioned vertically. Further the heat exchanger, which is useful as an oil cooler, is also usable for various applications for effecting heat exchange between different kinds of gases and fluids.

What is claimed is:

1. An oil cooler having an oil flow channel and air flow channel which are arranged alternately and formed by at least three flat plates arranged in parallel with one another at a predetermined spacing and opposed side walls provided between the adjacent flat plates, wherein the oil flow channel is formed from a blank of extruded aluminum material comprising opposed side walls and a platelike connecting wall interconnecting the opposed side walls, the platelike connecting wall being provided with a number of projections, arched when seen from one side, formed by cutting the platelike connecting wall and projecting upward and downward, the arched projections on the platelike connecting wall are arranged in the front-to-rear direction to provide a plurality of projection rows, the connecting wall further having a fluid passage opposite to every arched projection, the arched projections of each row projecting upward and downward alternatively with a flat portion formed between each arched projection and the arched projection adjacent thereto in the front-to-rear direction, the upwardly arched projections and the downwardly arched projections of the rows adjacent to each other being in a staggered arrangement transversely of the rows, so that each upward projection is adjacent to a downward projection in the transverse direction, each arched projection of the connecting wall having a wall thickness of 0.5 to 1.5 mm, a width of 1 to 10 times the wall thickness and a height of 2 to 10 mm, and the projections are arranged in the front-to-rear direction of the exchanger at a pitch of 3 to 30 mm.

* * * * *